United States Patent [19]

Takahashi

[11] 4,136,649

[45] Jan. 30, 1979

[54] DASHPOT

[75] Inventor: Akira Takahashi, Kyoto, Japan

[73] Assignee: Mitsubishi Jidosha Kogyo Kabushiki Kaisha, Japan

[21] Appl. No.: 754,526

[22] Filed: Dec. 27, 1976

[30] Foreign Application Priority Data

Jan. 16, 1976 [JP] Japan ..... 51-4524

[51] Int. Cl.[2] ..... F02D 11/08

[52] U.S. Cl. ..... 123/103 R; 261/DIG. 18; 261/DIG. 19; 123/103 E; 123/97 B; 261/65

[58] Field of Search ..... 123/97 B, 103 R, 103 E, 123/119 D, 119 DB, 124 R; 137/480; 261/DIG. 19, 65, DIG. 18

[56] References Cited

U.S. PATENT DOCUMENTS

| | | | |
|---|---|---|---|
| 2,059,410 | 11/1936 | Straub | 123/103 R |
| 2,424,836 | 7/1947 | Mallory | 261/DIG. 19 |
| 2,505,292 | 4/1950 | Mallory | 123/103 R |
| 3,327,695 | 6/1967 | Rhodes | 261/DIG. 18 |
| 3,486,491 | 12/1969 | White | 123/97 B |
| 3,623,465 | 11/1971 | Wawrziniok | 123/103 E |
| 3,805,760 | 4/1974 | Yagi | 123/103 R |
| 3,881,685 | 5/1975 | Hase | 261/DIG. 18 |
| 3,996,904 | 12/1976 | Kobuki | 261/DIG. 19 |
| 3,999,524 | 12/1976 | Kobayashi | 123/103 R |

*Primary Examiner*—Charles J. Myhre
*Assistant Examiner*—Jeffrey L. Yates
*Attorney, Agent, or Firm*—Robert E. Burns; Emmanuel J. Lobato; Bruce L. Adams

[57] ABSTRACT

A dashpot for impeding rapid closing of a throttle valve of a carburetor, especially for an automotive engine has an air passage that opens to the atmosphere, venting a dashpot chamber whose capacity increases when the dashpot operates. A delay device is provided in the air passage, and comprises an orifice and a nonreturn valve arranged in parallel, and in series therewith, a control valve that closes the air passage when an intake manifold vacuum exceeds a set value. The dashpot serves as a throttle positioner in the high engine rotation area, and as a regular dashpot in the low engine rotation area.

5 Claims, 5 Drawing Figures

DASHPOT

Detailed Description of the Invention

This invention relates to improvements in a dashpot for automotive engines of the type which reduces noxious unburned hydrocarbon emissions that are sent forth especially when the engine brake is operated.

When automotive speed is reduced by means of the engine brake, the throttle valve closes rapidly to raise the intake manifold vacuum, as a result of which combustion becomes incomplete and plenty of hydrocarbons are emitted. To prevent this hydrocarbon emission, dashpots have been used conventionally. The dashport of conventional design always starts operation at an approximately uniform throttle opening, irrespective of engine conditions.

Therefore, if the throttle opening at which the dashpot starts operation is increased in the conventional engine to minimize hydrocarbon emission, the engine brake becomes ineffective, especially in the low engine speed area. Conversely, if the throttle opening is decreased for greater engine brake effect, hydrocarbon reduction becomes limited.

An object of this invention is to provide an improved automotive dashpot that is designed to retard rapid closing of the carburetor throttle valve when the engine brake is operated.

Another object of this invention is to provide an improved automotive dashpot that serves as a throttle positioner when the engine brake is operated in the high engine speed area, and as a regular dashpot on operating the engine brake in the low engine speed area.

A further object of this invention is to provide an automotive dashpot that minimizes unburned emissions in exhaust gas without lessening the effect of the engine brake, especially in the low engine speed area.

Still another object of this invention is to provide an automotive dashpot that operates securely without causing hunting and other troubles.

All the aforesaid objects are accomplished by the new dashpot, which comprises a lever fixed to a throttle valve, a delay member that delays the closing motion of the throttle valve by coming into engagement with the lever, a diaphram device as the like incorporating a differential member operatingly connected to the delay member and in which one of two chambers, separated by the differential member and whose size reduces when the throttle valve closes, is opened to the atmosphere, the differential member being spring-urged in the direction to open the throttle valve. An air passage opens to the atmosphere, venting the other chamber, whose size reduces when the throttle valve opens, and a delay control device consists of an orifice and a nonreturn valve, permitting the passage of air only from the latter chamber to the atmosphere and arranged in parallel in the air passage, and a control valve provided in series with the delay control device in the air passage so as to close the passage when the intake manifold vacuum exceeds the set value.

In the accompanying drawings.

Figure 1:
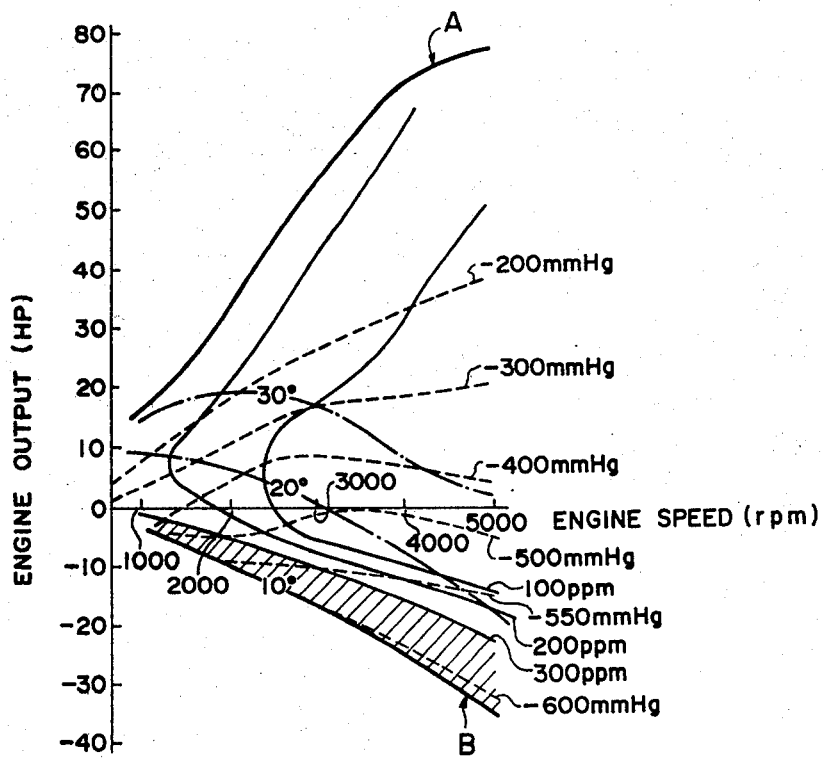
FIG. 1 is an engine's developed power chart showing the relationships between intake manifold vacuum, throttle valve opening and hydrocarbon concentration.

In FIG. 1, engine speed (rpm) is plotted along the abscissa and engine power output (hp) along the ordinate. The heavy solid curve A indicates the power developed when the throttle valve opens full. The solid curve B indicates the power at idling throttle opening. Broken curves are iso-vacuum curves showing the distribution of intake manifold vacuums. The dot-dash curve is an iso-throttle-opening curve, and light solid curves are iso-hydrocarbon-concentration curves showing the characteristic of hydrocarbon concentration in exhaust gas.

In this example, the idling throttle opening is set at an angle of 10° around the throttle shaft with respect to the full closing position. The hatched portion in FIG. 1 indicates the high hydrocarbon concentration region in which hydrocarbon concentration in exhaust gas exceeds 300 ppm. With increasing engine speed, the high hydrocarbon concentration region expands into areas in which the throttle opening increases, and also the higher the engine speed, the richer the hydrocarbon concentration. Therefore, in releasing the accelerator pedal to operate the engine brake in the high-speed condition, it is necessary to minimize the time to pass through the high hydrocarbon concentration region by expanding the throttle opening at which the dashpot starts operation to such an extent that does not lessen the effect of the engine brake. Meanwhile, when starting the dashpot under the low-speed condition, the throttle opening must be reduced to such an extent that does not make the engine brake inoperable.

Now some preferred embodiments of this invention will be described in detail by reference to the accompanying drawings in which the same or similar parts are designated by like reference characters.

Figure 2:
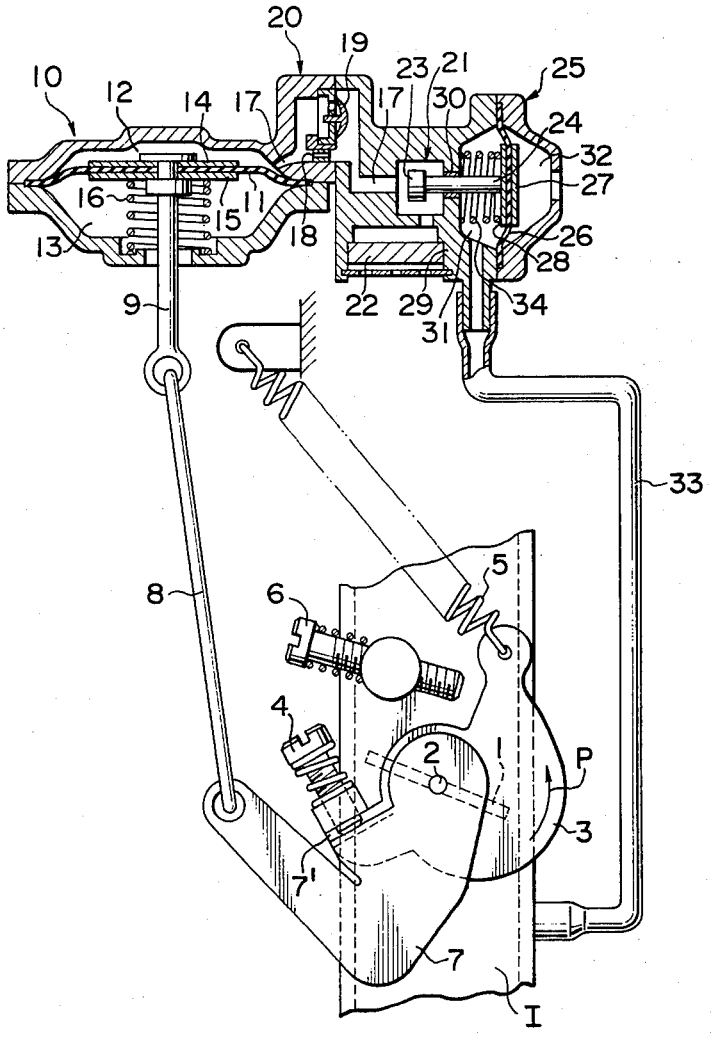
FIG. 2 is a side elevation, partly in section, of the first embodiment of this invention.

In the first embodiment of this invention shown in FIG. 2, a throttle stop screw 4 is fitted to an end of a lever 3 fixed to an end of a throttle shaft 2 that rotates a throttle valve 1 of a carburetor in an internal cumbustion engine (not otherwise shown in general). To the other end of the lever 3 is fitted a return spring 5 that urges the throttle valve 1 in the closing direction indicated by the arrow P in FIG. 2. When the lever 3 comes in contact with an idle speed adjusting screw 6 provided on the carburetor proper, the throttle valve 1 stops at the idling position. To the opposite end of the throttle shaft 2 is rotatably fitted a throttle arm 7 as a delay member that is connected to a rod 9 of a first, throttle-operated and selectively throttle operating diaphragm device 10 through a link 8. An engaging portion 7' that comes in contact with the throttle stop screw 4 is formed on the throttle arm 7.

The first diaphragm device 10 is bisected into chambers 12 and 13 by a diaphragm 11. The upper end of the rod 9 is fixed to the center of the diaphragm 11, together with support plates 14 and 15. The rod 9 moves up and down with the diaphragm 11.

Of the two chambers 12 and 13, the one 13, whose capacity or size reduces when the throttle valve 1 closes, opens direct into the atmosphere and contains a spring 16 that pushes the diaphragm 11 upward in FIG. 2 to enlarge this chamber, as shown. This chamber 12 communicates with the atmosphere through an air passage 17, in a manner described below.

In the air passage 17 are provided in series a delay device 20, which consists of an orifice 18 and a nonreturn valve 19, permitting the passage of air only from said chamber 12 to the atmosphere, arranged in parallel, a delay control valve 21 for opening and closing the air passage 17, and an air filter 22.

A valve disc 23 of the control valve 21 is fixed through a rod 24 to the center of a diaphragm 26 in a second diaphragm device 25, together with support plates 27 and 28. The rod 24 is slidably passed through a guide opening 30 made in a housing 29 so as to move in response to the displacement of the diaphragm 26.

The second diaphragm device 25 is divided by the diaphragm 26 into two chambers 31 and 32. The chamber 32, opposite the control valve 26, opens direct into the atmosphere, and the chamber 31, communicating with the control valve through the opening 30, also communicates through a vacuum tube 33 with the engine's intake passage I downstream of the throttle valve 1. This chamber 31 contains a spring 34 that pushes the diaphragm 26 toward the other chamber 32.

When the vacuum introduced through the vacuum tube 33 into the chamber 31 of this embodiment exceeds 500 mmHg, the control valve diaphragm 26 is sucked to the left in FIG, 2, against the pushing force of the spring 34, whereupon the control valve 21 closes the air passage 17. When the vacuum is below 500 mmHg, this diaphragm 26 is kept on the right in FIG. 2 under the influence of the urging force of the spring 34, and the control valve 21 opens.

When the throttle stop screw 4 contacts the engaging portion 7' of the throttle arm 7 while the diaphragm 11 of the throttle operated device 10 is in the topmost position in FIG. 2, opening of the throttle valve 1 is adjusted by this screw 4, to 15° in this embodiment.

The operation of the embodiment described above will be explained hereunder. When the driver abruptly releases the accelerator pedal, not shown, to apply the engine brake on a running automobile, the throttle valve 1 rapidly closes, turned in the direction of the arrow P in FIG. 2 by the tension of the return spring 5. When the throttle valve 1 is in the position of 15° opening, the throttle stop screw 4 comes in contact with the engaging portion 7' of the throttle arm 7. If the control valve 21 opens the air passage 17 at this time, the throttle arm 7 also starts rotation interlocking in the closing direction P.

As the throttle arm 7 starts rotation, the diaphragm 11 is pulled downward through the link 8 and rod 9, whereupon the capacity or size of the chamber 12 tends to suddenly increase and air flows into it through the air passage 17. Because the nonreturn valve 19 is closed, the air flows in only through the orifice 18, and therefore meets with considerable resistance. This resistance delays the closing of the throttle valve 1 pulled by the return spring 5. Accordingly, this device serves as a regular dashpot that slows the closing motion of the throttle valve 1 from the 15° opening to the idling 10° opening.

Meanwhile, if the delay control valve 21 closes the air passage 17 when the engine brake is applied, the air inflow into the chamber 12 is checked. Therefore, when the diaphragm 11 descends very little from the topmost position in FIG. 2, vacuum in the chamber 12 becomes high and diaphragm 11 stops its motion. Now the throttle-operated device 10 becomes, and operates as a throttle positioner.

In the above-described embodiment, the nonreturn valve 19 is provided in the air passage 17 in parallel with the orifice 18, so that, when the throttle valve 1 is opened for acceleration, the air in the chamber 12 is discharged into the atmosphere without resistance, thereby permitting the diaphragm 11 urged by the spring 16 to rapidly move upward in FIG. 2. By this means, responsiveness during the rapid deceleration following the rapid acceleration is increased.

Referring next to the engine's developed power chart in FIG. 3, the operation of the above-described embodiment will be described. Point C in FIG. 3 indicates a drive condition at approximately 3,000 rpm of engine speed and at approximately 20 hp of engine power. If the accelerator pedal is suddenly released at the point C to put on the engine brake, the drive condition thereupon falls as a result of a sharp drop in engine power as indicated by the solid line in FIG. 3. As seen from FIG. 1, the throttle opening becomes 15° after the intake manifold vacuum has sharply risen to above 500 mmHg. Accordingly, the drive condition transits from the point C to point F where the throttle opening is 15°, then travels over the 15°iso-throttle-opening curve N in the direction in which engine rotation decreases, as far as point G where the curve N intersects with the 500-mmHg iso-intake-manifold-vacuum curve Q. Beyond the point G, the drive condition travels over the curve Q in the direction in which engine speed decreases, then reaches point L on the solid curve B.

While the drive condition transits from the point G to the point L over the iso-vacuum curve Q, intake manifold vacuum varies around 500 mmHg. The control valve 21 opens and closes in accordance with the vacuum variation, thereby controlling the supply of air into the chamber 12 to adjust the descending speed of the diaphragm 11. Meanwhile, gradual inflow of air through the orifice 18 into the chamber 12 effectively prevents hunting of the control valve 21.

Figure 3:
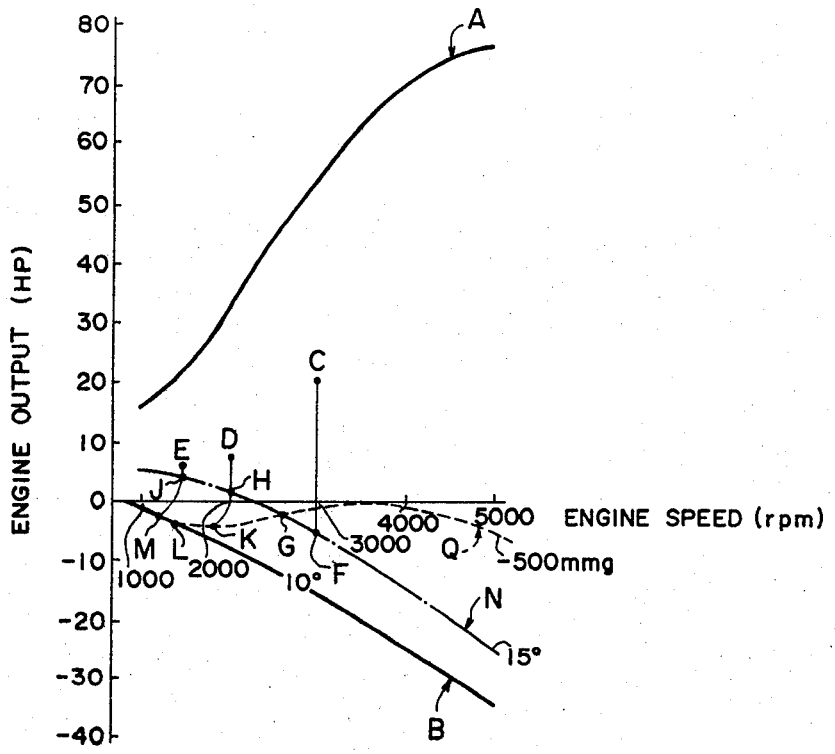
FIG. 3 is a chart explaining the operation of the first embodiment.

Point D in FIG. 3 indicates a drive condition at approximately 2,000 rpm of engine speed and at approximately 8 hp of engine power. If the accelerator pedal is suddenly released at the point D to put on the engine brake, throttle opening becomes 15° before intake manifold vacuum reaches 500 mmHg. Therefore, this embodiment operates as a dashpot at and beyond a drive condition indicated by point H on the curve N. From point K where intake manifold vacuum becomes 500 mmHg, the drive condition travels over the curve Q in the direction L.

If the engine brake is put on at point E in FIG 3, which indicates a drive condition at approximately 1,500 rpm of engine speed and at approximately 7 hp of engine power, this embodiment functions as a dashpot at and beyond a drive condition indicated by point J on the curve N. The drive condition at the point J transfers, with some delay, to a drive condition at point M on the solid curve B.

As may be understood from the above, this embodiment functions as a throttle positioner in the high engine speed area, and as a conventional dashpot in the low engine speed area. Consequently, even if this embodiment starts its operation as a dashpot at small throttle opening, hydrocarbon emission in the high engine speed area is decreased sufficiently. By reducing throttle opening during its operation as a dashpot, the engine brake is expected to achieve its effect adequately.

In this embodiment, the delay device 20 is provided in the air passage 17 between the chamber 12 and the control valve 21. The same effect can be achieved by placing this delay device 20 in the air passage 17 between the control valve 21 and the air filter 22.

Figure 4:
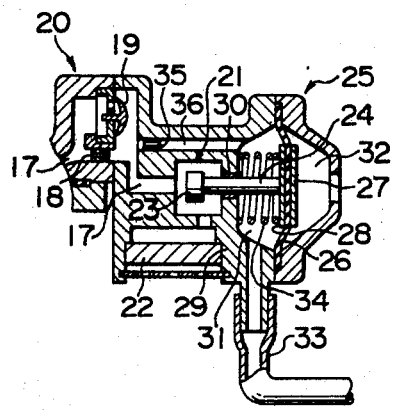
FIG. 4 is a cross-sectional view showing the principal portion of the second embodiment of this invention.

Referring next to FIG. 4, the second embodiment of this invention will be described. This embodiment is similar to the above-described first embodiment, with the exception that the air passage 17 between the delay device 20 and the delay control valve 21 communicates with the chamber 31 by a vacuum passage 36 provided with an orifice 35. Owing to this construction, intake manifold vacuum acts on the air passage 17 through the vacuum tube 33, the chamber 31, and the vacuum passage 36. Because of the flow resistance at the orifice 35, however, the intake manifold vacuum exercises so little influence on the air passsge 17 that it exerts no influence on the chamber 12 when the delay control valve 21 opens. But when this valve 21 closes, the intake manifold vacuum is introduced into the chamber 12. On releasing the accelerator pedal, the throttle stop screw 4 comes in contact with the throttle arm 7 under the influence of the return force of the return spring 5. Then the diaphragm 11 descends until a force to suck the diaphragm 11 upward, comparable to the return force of the return spring 5, arises. But if, on applying the engine brake, excess air remains in the chamber 12 or excess air flows into the chamber 12 due to a delay in the closing motion of the control valve 21 or other reason, the throttle valve 1 is suddenly closed to beyond the opening at which the first diaphragm device 10 operates as a throttle positioner. Then there arises a tendency that the diaphragm 11 decends to below the desired position and the throttle valve closes beyond the set opening. This tendency is prevented by sucking the air in the chamber 12 through the orifice 18 or through the nonreturn valve 19 and orifice 35 into the chamber 31, when the control valve 21 closes.

Figure 5:
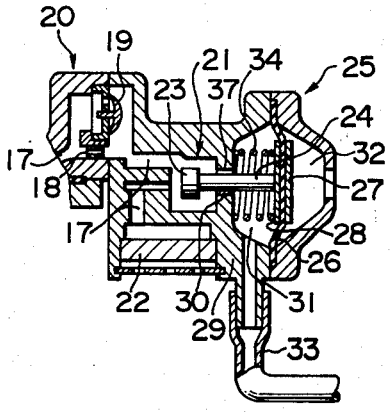
FIG. 5 is a cross-sectional view showing a modified example of the second embodiment.

The above-described vacuum passage 36 may be constructed as illustrated in FIG. 5. This design is simpler and more compact than the second embodiment described above. More specifically, an aperture 37 that connects the air passage 17 with the chamber 31 is formed in the internal surface of the guide opening 30 through which the rod 24 is passed.

In all embodiments described above, first and second the diaphragm devices 10 and 25 are employed as differential means, But it is needless to say that these diaphragm devices may be replaced with pistons or other means that are operated on the differential-pressure principle.

What is claimed is:

1. A dashpot unit for preventing sudden closing of a carburetor throttle valve of an internal combustion engine, comprising;

a lever and a shaft secured thereto for setting a throttle valve of an engine, the lever having a return spring for urging the lever, and thereby the shaft, to close the valve, the lever also having a stop disposed so that the lever contacts it when the valve provides a predetermined degree of opening, during a motion of the valve to close in an idling condition of the engine;

a delay member secured to the shaft for slowing the closing of the valve;

a first pressure differential responsive device having a first pressure differential responsive member linked to the delay member, the device comprising a housing with two chambers separated by the responsive member, and a spring for urging that member to move the delay member linked to it to open the valve and for thereby increasing the size of one of the two chambers, to slow the motion of the valve, while the size of the other chamber is correspondingly decreased, the one chamber having a vent;

means defining an air passage opening to the atmosphere to vent also the other chamber;

a vent delay device contained in the air passage and having means defining an orifice, the passage also having, in parallel with the orifice, a non-return valve for permitting only passage of air from the other chamber to the atmosphere through the latter valve;

a delay control valve interposed on the air passage in series with and closer to the atmosphere than the delay device, for opening and closing the passage containing the delay device; and a second pressure differential responsive device for actuating the delay control valve, comprising a second pressure differential responsive member linked to the delay control valve, means defining a vacuum chamber on one side of the latter member and a chamber vented to the atmosphere on the other side thereof, a vacuum tube connecting the vacuum chamber with a portion of an engine intake passage downstream of the throttle valve to cooperate with the vented chamber in providing a differential pressure in the second responsive device, the vacuum chamber being connected with the other chamber of the first responsive device by the air passage to cooperate with the one chamber in providing differential pressure in that device, and a second spring in the second responsive member to open the delay control valve linked to it;

whereby, when a vacuum exceeding a predetermined level occurs in said portion of the intake passage and thereby in the vacuum chamber, the vacuum draws the second responsive member against the force of the second spring to close the delay control valve and thus the air passage, thereby enabling the first pressure differential responsive device to position the throttle valve in a high engine speed area, and also to function as a dashpot in a low engine speed area, thus minimizing emission of unburned exhaust gas from the engine regardless of whether the engine operates in the high or low engine speed area.

2. A dashpot unit according to claim 1, in which the second differential device also includes means defining a vacuum passage and an orifice therein for introducing an intake manifold vacuum into the air passage between the delay device and the delay control valve.

3. A dashpot unit according to claim 2, in which the vacuum passage communicates through the orifice therein, with the vacuum chamber in the second pressure differential responsive device for actuating the delay control valve.

4. A dashpot unit according to claim 2, in which the second pressure differential device has an opening in the vacuum passage and between the chambers of the device, and a rod for the linking of the second responsive member to the delay control valve, the rod extending through the opening.

5. A device unit according to claim 1, wherein each responsive member is a diaphragm.

* * * * *